US011413659B1

(12) United States Patent
Bosarge

(10) Patent No.: US 11,413,659 B1
(45) Date of Patent: Aug. 16, 2022

(54) SINK ACCESSORY FOR SINK DIVIDER WALL

(71) Applicant: John Gary Bosarge, Spanish Fort, AL (US)

(72) Inventor: John Gary Bosarge, Spanish Fort, AL (US)

( * ) Notice: Subject to any disclaimer, the term of this patent is extended or adjusted under 35 U.S.C. 154(b) by 387 days.

(21) Appl. No.: 16/778,748

(22) Filed: Jan. 31, 2020

(51) Int. Cl.
*B24B 3/54* (2006.01)
*B08B 1/00* (2006.01)
*E03C 1/18* (2006.01)

(52) U.S. Cl.
CPC ..... *B08B 1/005* (2013.01); *B24B 3/54* (2013.01); *E03C 1/18* (2013.01)

(58) Field of Classification Search
None
See application file for complete search history.

(56) References Cited

U.S. PATENT DOCUMENTS 3,280,514 A 10/1966 Raymond
4,494,339 A 1/1985 Pittaway
5,577,289 A * 11/1996 Russell ..... B32B 27/12 4/581
8,966,702 B1 3/2015 Green
9,115,484 B2 * 8/2015 Fulford ..... E03C 1/186
9,775,470 B2 10/2017 Eilmus et al.
9,930,998 B2 4/2018 Palazzolo et al.
10,337,178 B2 7/2019 Bomatter et al.
2011/0056016 A1 3/2011 Mun

OTHER PUBLICATIONS

The Container Store, "Kohler Kitchen Surface Squeegee", Web Page (Year: 2016).*

* cited by examiner

*Primary Examiner* — Joseph J Hail
*Assistant Examiner* — Dana Lee Poon
(74) *Attorney, Agent, or Firm* — Goldstein Law Offices, P.C.

(57) ABSTRACT

A sink accessory for attachment to a sink divider wall of a double basin sink is provided. The sink accessory includes a first elongated tubular body, a second elongated tubular body, a scouring pad attached to an upper surface of the first elongated tubular body, an arm extending outwardly from a lower surface of the elongated tubular body, and a squeegee extending outwardly from the arm. A first magnet is attached to the first elongated tubular body. A second magnet is attached to the second elongated tubular body. The first magnet and the second magnet attract each other to fasten the first elongated tubular body and the second elongated tubular body to the sink divider wall when the first elongated tubular body and the second elongated tubular body are positioned against a top surface and a bottom surface of the sink divider wall, respectively.

20 Claims, 9 Drawing Sheets

SINK ACCESSORY FOR SINK DIVIDER WALL

TECHNICAL FIELD

The present disclosure relates generally to sink accessories for double basin sinks. More particularly, the present disclosure relates to a sink accessory for attachment to a sink divider wall of a double basin sink including a mounting mechanism for attaching the sink accessory to the divider wall and selectively repositioning the sink accessory on the divider wall to accommodate left and right handed individuals, a scouring pad for scrubbing a knife, and a squeegee for removing excess food particles or waste materials off of the knife.

BACKGROUND

When washing kitchen utensils such as cutlery and other sharp-edged utensils and devices, individuals traditionally utilize scouring pads or other abrasive devices to scrub off the food particles or waste materials that have adhered firmly to the utensils. This operation, however, often necessitates reaching for a scrubbing device resting in a container adjacent to the sink and then replacing it upon completion of the scrubbing. This is disadvantageous because the scrubbing device often becomes displaced and/or requires a secondary container for the scrubbing device. Moreover, current devices for cleaning cutlery typically require an individual to use both hands simultaneously, one hand to hold the scouring device and the other to hold the utensil to be cleaned. This is disadvantageous because constantly having to maneuver the sharp edge of these utensils with both hands to adequately clean the sharp edges poses obvious risks of injury to the individual cleaning the cutlery.

Accordingly, there is a need for a sink accessory that is removably attachable to a sink wall and includes a scouring pad for cleaning sharp-edged utensils and a squeegee for facilitating the removal of excess food particles and waste materials from sharp-edged utensils, thereby enabling a user to clean the utensil using only one hand.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a sink accessory that is attachable to the divider wall of a double basin sink. Accordingly, the present disclosure provides a sink accessory including a magnetic mounting member that enables a user to removably attach the sink accessory to the sink divider wall.

An aspect of an example embodiment in the present disclosure is to provide a sink accessory that enables a user to clean cutlery and other sharp-edged utensils in a safe and efficient manner using only one hand. Accordingly, the present disclosure provides a sink accessory that is attachable to the divider wall of a double basin sink and includes a scouring pad that is parallel to a surface of a basin of the sink.

An aspect of an example embodiment in the present disclosure is to provide a sink accessory that provides more than one means of cleaning and washing cutlery and other sharp-edged utensils in a safe and efficient manner, still using only one hand. Accordingly, the present disclosure provides an arm positioned into a basin of the double basin sink that includes a squeegee having a blade that extends parallel relative to the basin of the sink.

An aspect of an example embodiment in the present disclosure is to provide a sink accessory including a means for sharpening cutlery. Accordingly, the present disclosure provides a sink accessory including a removably attached knife sharpener.

An aspect of an example embodiment in the present disclosure is to provide a sink accessory that can be attached to a sink so as to accommodate both right-handed and left-handed users. Accordingly, the present disclosure provides a mounting member that enables a user to mount the sink accessory in at least two positions relative to the divider wall.

An aspect of an example embodiment in the present disclosure is to provide a sink accessory a means for attaching the sink accessory to and from a sink divider wall. Accordingly, the present disclosure provides a mounting member including a suction cup or a first magnet disposed within a first discrete body of the sink accessory and a second magnet disposed in second discrete body of the sink accessory, enabling engagement of the first body and second body to a sink divider wall via the first magnet and second magnet.

An aspect of an example embodiment in the present disclosure is to provide a sink accessory having a convenient means for removably attaching and detaching the sink accessory to and from a sink divider wall. Accordingly, the present disclosure provides a first body having a first magnet and a second body having an adhesive and a second magnet, wherein the adhesive enables a user to attach the second body to a bottom surface of a sink divider wall creating a magnetic field through the sink divider wall which enables a user to removably attach the first magnet to a top surface of the sink divider wall via the first magnet.

An aspect of an example embodiment in the present disclosure is to provide a sink accessory having a magnetic mounting mechanism that does not interfere with the washing of metallic utensils by attracting them to the sink accessory. Accordingly, the present disclosure provides a magnetic diffuser that separates the magnet of the magnetic mounting mechanism from the scouring pad and squeegee of the sink accessory.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION

Figure 1:
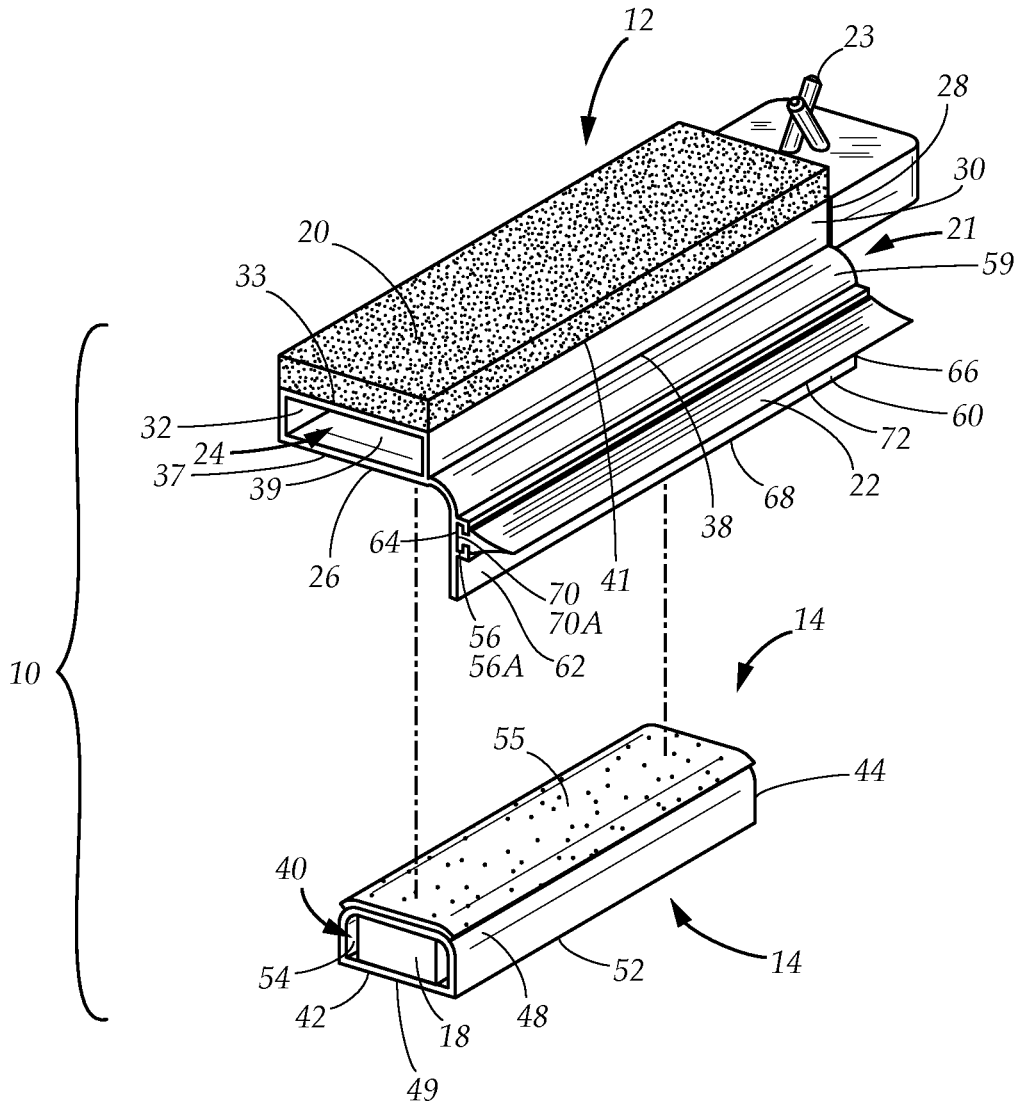
FIG. 1 is an exploded view of the sink accessory, illustrating the first elongated tubular body and the second elongated tubular body attracting each other via the first magnet and second magnet according to one embodiment of the present disclosure.

FIG. 1 illustrates a sink accessory 10 for use with a double basin sink including a sink divider wall having a top surface and a bottom surface. The sink accessory 10 comprises a first elongated tubular body 12, a second elongated tubular body 14, a first magnet 16 (see FIG. 2), a second magnet 18, a scouring pad 20, an arm 21, and a squeegee 22. In some embodiments, the sink accessory 10 comprises a knife sharpener 23.

In embodiments, the first elongated tubular body 12 defines an interior volume 24 and includes a first open end 26, a second open end 28 (see FIG. 8), a first sidewall 30, a second sidewall 32, an upper surface 33, a lower surface 37, an interior surface 39, and a longitudinal length. The upper surface is bounded by a first perimeter edge 41 and the lower surface is bounded by a second perimeter edge 38. The first sidewall 30 and the second sidewall 32 extend between the upper surface 33 and the lower surface 37, and the first sidewall 30 and the second sidewall 32 extend between the first perimeter edge 41 and the second perimeter edge 38.

In embodiments, the second elongated tubular body 14 defines an interior volume 40 and includes a first end 42, a second end 44 opposite the first end 42, an upper surface 48 including an arcuate edge, a lower surface 49 defining a third perimeter edge 52, an interior surface 54, and an adhesive 55. The adhesive 55 is disposed on the upper surface 48 of the second elongated tubular body 14. In some embodiments, the adhesive 55 is removably attached to the upper surface of the second elongated tubular body 14. In other embodiments, the adhesive is fixedly attached to the upper surface 48 of the second elongated tubular body 14.

In embodiments, the second magnet 18 is disposed within the interior volume 40 of the second elongated tubular body 14. In some embodiments, the second magnet 18 is removably attached to the interior surface 54 of the second elongated tubular body 14. In other embodiments, the second magnet 18 is integral to the interior surface 54 of the second elongated tubular body 14. The first magnet 16 (see FIG. 2) and the second magnet 18 attract each other to fasten the first elongated tubular body 12 and the second elongated tubular body 14 against a sink divider wall extending therebetween.

In embodiments, the scouring pad 20 is attached to the upper surface 33 of the first elongated tubular body 12. In some embodiments, the scouring pad 20 is coterminous with the upper surface 33 of the first elongated tubular body 12 such that the scouring pad 20 has the same length and width as the upper surface 33. In certain embodiments, the scouring pad 20 comprises a mesh material including plastic or metal. In other embodiments, the scouring pad 20 comprises a sponge-like material including polyester, polyurethane, or vegetal cellulose.

In embodiments, the arm 21 extends outwardly from the lower surface 37 of the first elongated tubular body 12. In some embodiments, the arm extends outwardly from the first sidewall 30 of the first elongated tubular body 12. The arm 21 comprises an arcuate region 59, a planar region 60, and a first fastener 56. The arcuate region 59 curves away from the lower surface 37 of the first elongated tubular body 12 into the planar region 60. The arcuate region 59 is connected to the planar region 60. The planar region 60 comprises an outer surface 62 facing away from the first elongated tubular body 12. The planar region 60 extends away from the lower surface 37 of the first elongated tubular body 12. In one embodiment, the planar region 60 is rectangular. The outer surface 62 of the planar region 60 defines a first lateral edge 64, a second lateral edge 66, a longitudinal length between the first lateral edge 64 and second lateral edge 66, and a third longitudinal edge 68. In one embodiment, the first lateral edge 64 and the second lateral edge 66 of the planar region 60 extend perpendicularly relative to the upper surface and the lower surface of the first elongated tubular body 12. In another embodiment, the third longitudinal edge 68 of the planer region 60 is parallel relative to the upper surface and the lower surface of the first elongated tubular body 12.

In embodiments, the first fastener 56 comprises a slot 56A disposed on the surface 62 of the planar region 60 of the arm 21. The first fastener 56 is configured to removably receive the squeegee 22 to attach the squeegee to the arm 21. In one embodiment, the first fastener 56 comprises a slot 56A configured to removably receive at least a portion of the squeegee 22. In another embodiment, the first fastener 56 extends from the first lateral edge 64 to the second lateral edge 66 of the planar region 60 of the arm 21 such that the first fastener 56 is coterminous with the longitudinal length of the arm 21.

In embodiments, the squeegee 22 comprises a second fastener 70 configured to removably engage the slot 56A. In some embodiments, the second fastener 70 comprises a flange 70A that mates with the slot 56A (see FIG. 2) to fasten the squeegee 22 to the arm 21. In one embodiment, the flange 70A and the slot 56A mate similar to a dovetail joint, wherein the flange 70A is a tail and the slot 56A is a socket designed to fit the tail in the socket. In other embodiments, the flange 70A includes substantially the same cross-sectional area as the slot 56A so that the flange 70A friction fits within the slot 56A. In one embodiment, the flange 70A and the slot 56A include the same length, such that the flange 70A and the slot 56A are coterminous with each other when mated.

In embodiments, the squeegee 22 comprises a blade 72 that extends outwardly relative to the surface 62 of the planar region 60 when the squeegee 22 is attached to the arm 21. In one embodiment, the blade 72 extends perpendicularly outwardly relative to the surface 62 of the planar region 60. In some embodiments, the blade 72 comprises a flexible rubber material including a smooth surface. In other embodiments, the blade 72 comprises a flexible silicone material including a smooth surface.

Figure 2:
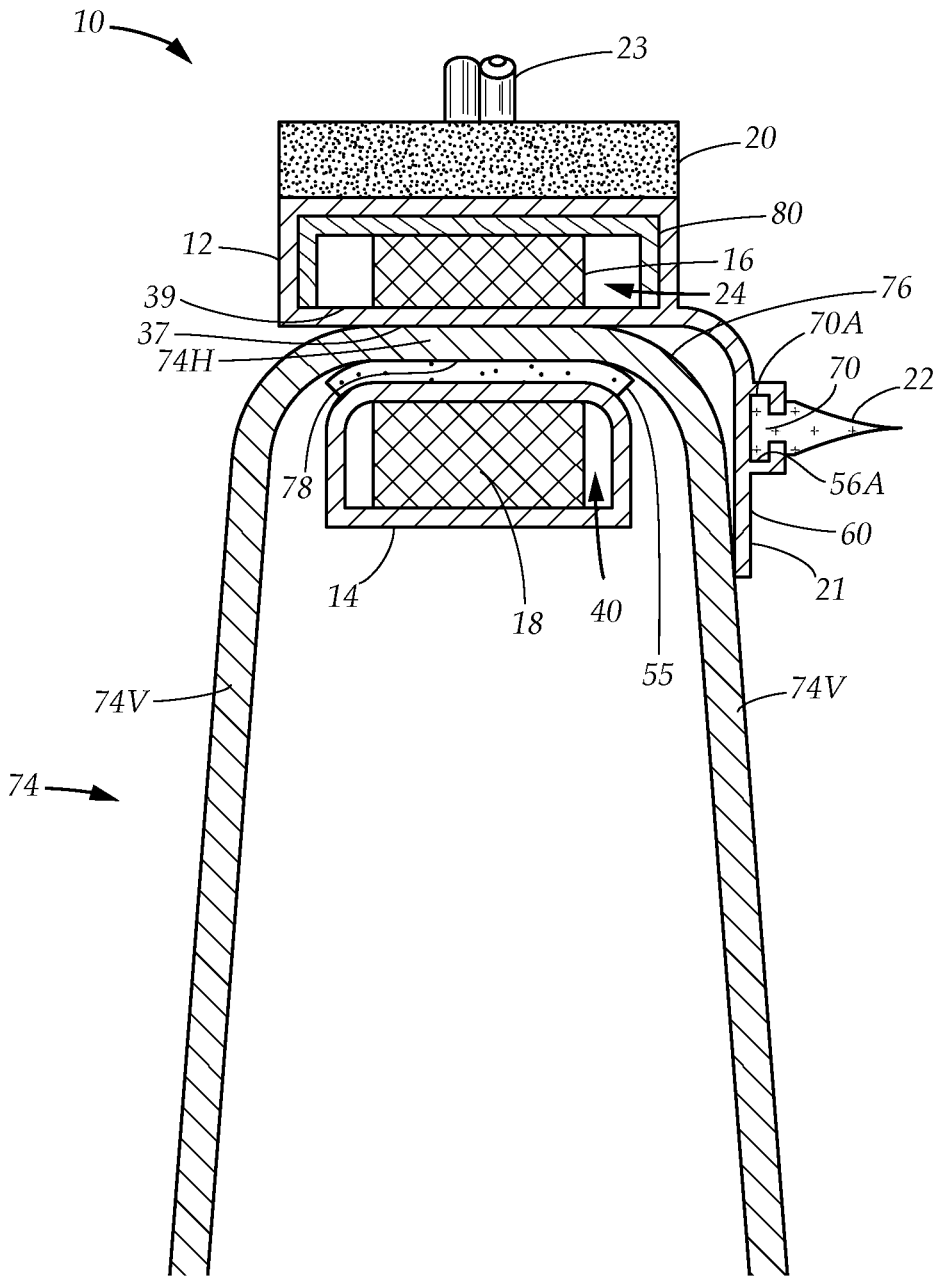
FIG. 2 is a cross-sectional view of the sink accessory device, illustrating the sink accessory attached to the divider wall of a double basin sink via the first magnet and the second magnet as well as the relative positioning of the sink accessory when attached to the divider wall according to one embodiment of the present disclosure.

FIG. 2 shows a sink divider wall 74 having a horizontal portion 74H extending between two vertical walls 74V. The horizontal portion 74H has a top surface 76 and a bottom surface 78. The sink accessory 10 is attached to the horizontal portion 74H. To facilitate attachment, the first magnet 16 is disposed within the interior volume 24 of the first elongated tubular body 12. In some embodiments, the first magnet 16 is removably attached to the interior surface 39 of the first elongated tubular body 12. In other embodiments, the first magnet 16 is integral, or unitary, with the interior surface 39 of first elongated tubular body 12. The first magnet 16 and the second magnet 18 are configured to attract each other. In this way, when the lower surface 37 of the first elongated tubular body 12 is positioned against the top surface 76 of the horizontal portion 74H of the sink divider wall 74 and the second elongated body 14 is positioned against the bottom surface 78 of the horizontal portion 74H of the sink divider wall 74, the first magnet 16 and second magnet 18 attract each other through the horizontal portion 74H and the first elongated tubular body 12 and the second elongated tubular body 14 thereby fastening securely to the sink diver wall 74.

In one operation, a user attaches the second elongated tubular body 14 to the bottom surface 78 of the sink divider wall 74 via the adhesive 55 to maintain the second elongated tubular body 14 in position against the bottom surface 78 (against gravity) until the first elongated tubular body 12 is positioned against the top surface 76. When attached, the second magnet 18 faces the top surface 76 of the sink divider wall 74. The second magnet 18 thereby produces a magnetic field through the sink divider wall 74 that attracts the first magnet 16 of the first elongated tubular body 12. The constant magnetic field in and/or around the top surface 76 of the second elongated tubular body 14 enables a user to removably attach the first elongated body 12 to the top surface 76 of the sink divider wall 74 via the first magnet 16.

When the sink accessory 10 is attached to the sink divider wall 74, the arm 21 extends from the lower surface 37 of the first elongated tubular body 12 down one of the vertical walls 74V of the sink divider wall 74. In some embodiments, the planar region 60 is generally parallel with said vertical wall 74V of the sink divider wall 74 when the first elongated tubular body 12 is attached to the top surface 76 of the sink divider wall 74. As the vertical walls 74V are generally slightly tapered outwardly, the planar region 60 may abut a portion of the sink divider wall 74 to further stabilize the first elongated tubular body 12 when the first elongated tubular body 12 is attached to the top surface 76 of the sink divider wall 74.

In embodiments, the sink accessory 10 further comprises a magnetic diffuser 80 that separates the first magnet 16 from the scouring pad 20 and the arm 21. In some embodiments, the magnetic diffuser 80 is disposed within the interior volume 24 of the first elongated tubular body 12. In one embodiment, the magnetic diffuser 80 lines the interior surface 39 of the first elongated tubular body 12 except the portion of the interior surface 39 that is adjacent to the lower surface 37 of the first elongated tubular body 12. In some embodiments, the magnetic diffuser 80 is attached to the interior surface 39 of the first elongated tubular body 12. In other embodiments, the magnetic diffuser 80 is integral to the interior surface 39 of the first elongated tubular body 12. The magnetic diffuser 80 reduces and/or blocks the magnetic field created by the first magnet 16 from extending in an undesirable direction around the scouring pad 20, the arm 21, and the knife sharpener 23. In this way, when the sink accessory 10 is in use, the first magnet 16 does not attract metallic objects being washed and cleaned on the scouring pad 20 and arm 21 and interfere with washing.

In some embodiments, the sink accessory comprises a separate mounting member that is configured to removably attach the first elongated tubular body 12 to the top surface 76 of the sink divider wall 74. In one embodiment, the mounting member comprises a suction cup.

Figure 3:
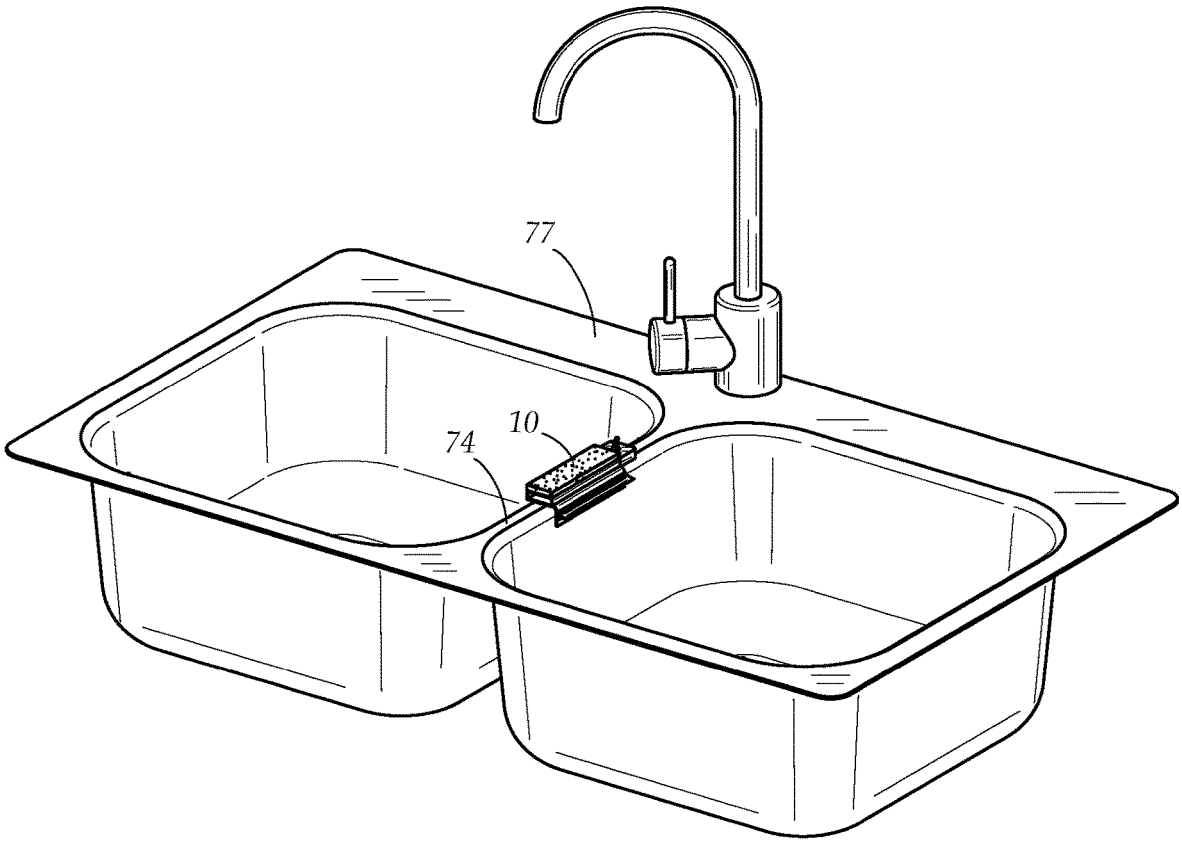
FIG. 3 is a perspective view of the sink accessory attached to the divider wall of a double basin sink according to one embodiment of the present disclosure.
Figure 4:
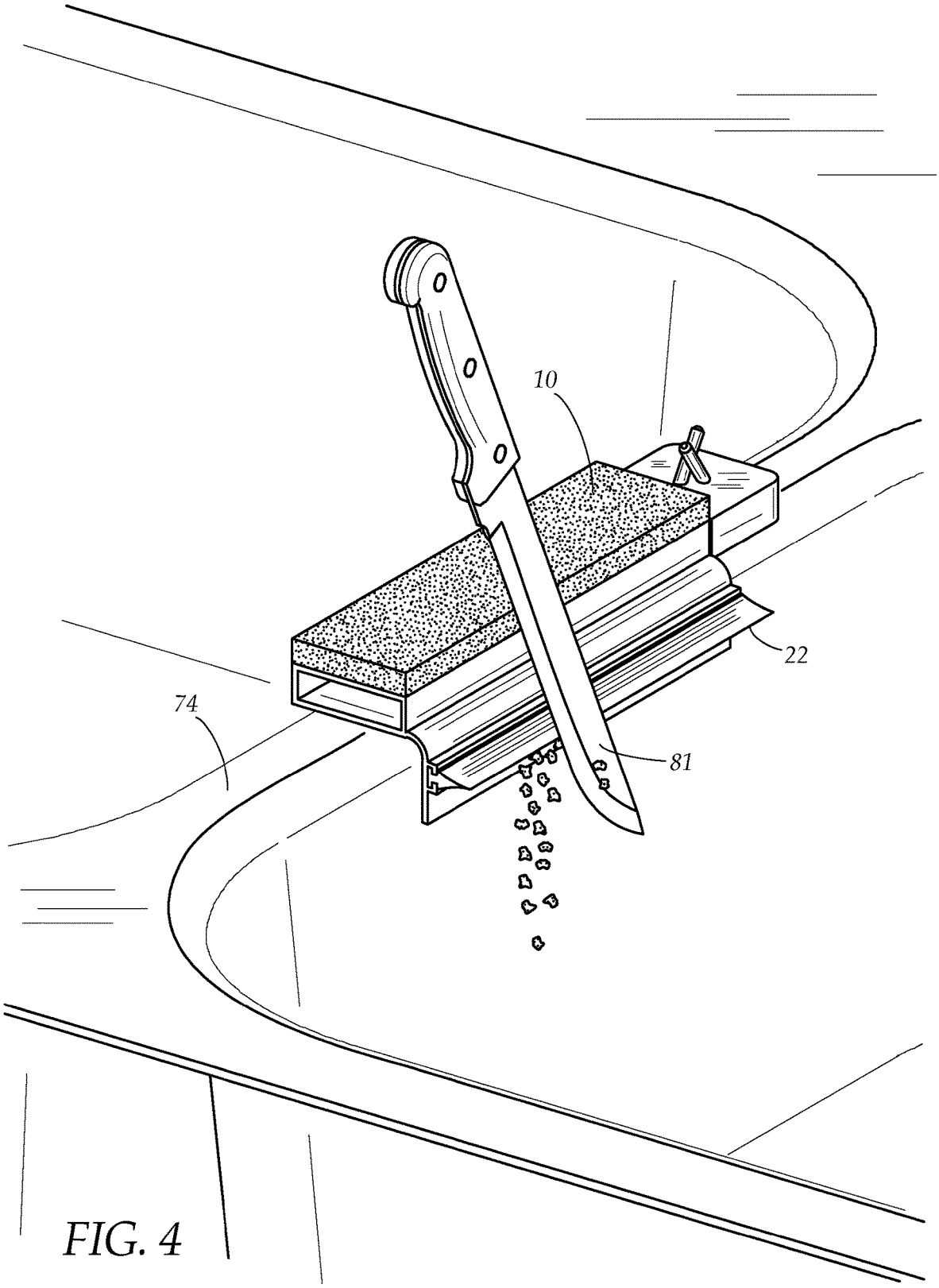
FIG. 4 is a perspective view of the sink accessory attached to the divider wall of a double basin sink, illustrating the squeegee in use according to one embodiment of the present disclosure.
Figure 5:
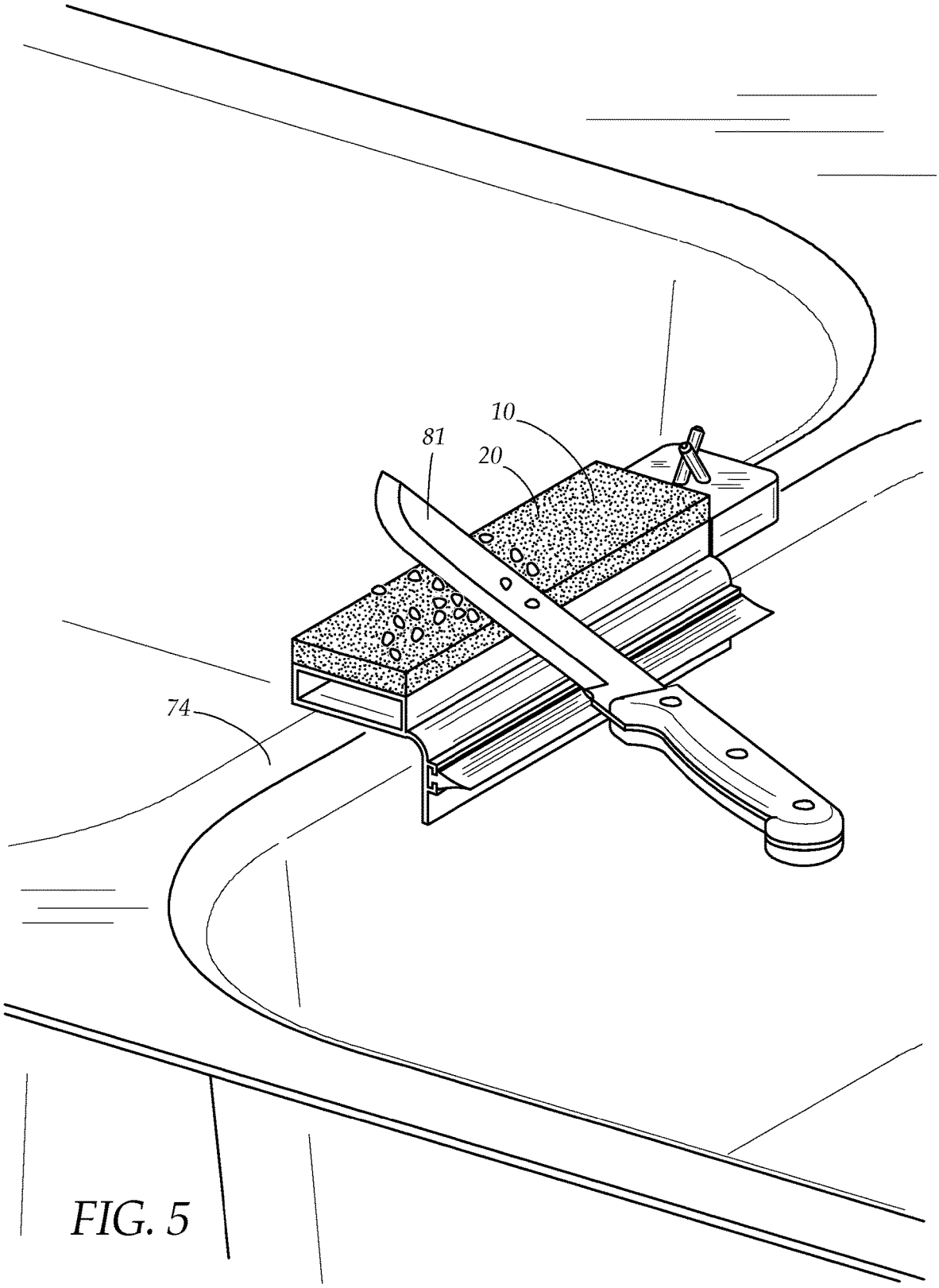
FIG. 5 is a perspective view of the sink accessory attached to the divider wall of a double basin sink, illustrating the scouring pad in use according to one embodiment of the present disclosure.

FIG. 3 shows the sink accessory 10 mounted to the sink divider wall 74 of a double basin sink 77. FIG. 4 shows the squeegee 22 being employed to remove excess waste food particles and waste material off of a knife 81 while the sink accessory 10 is mounted to the sink divider wall 74. FIG. 5 shows scouring pad 20 being employed to clean a knife 81 while the sink accessory 10 is mounted to the sink divider wall 74.

Figure 7:
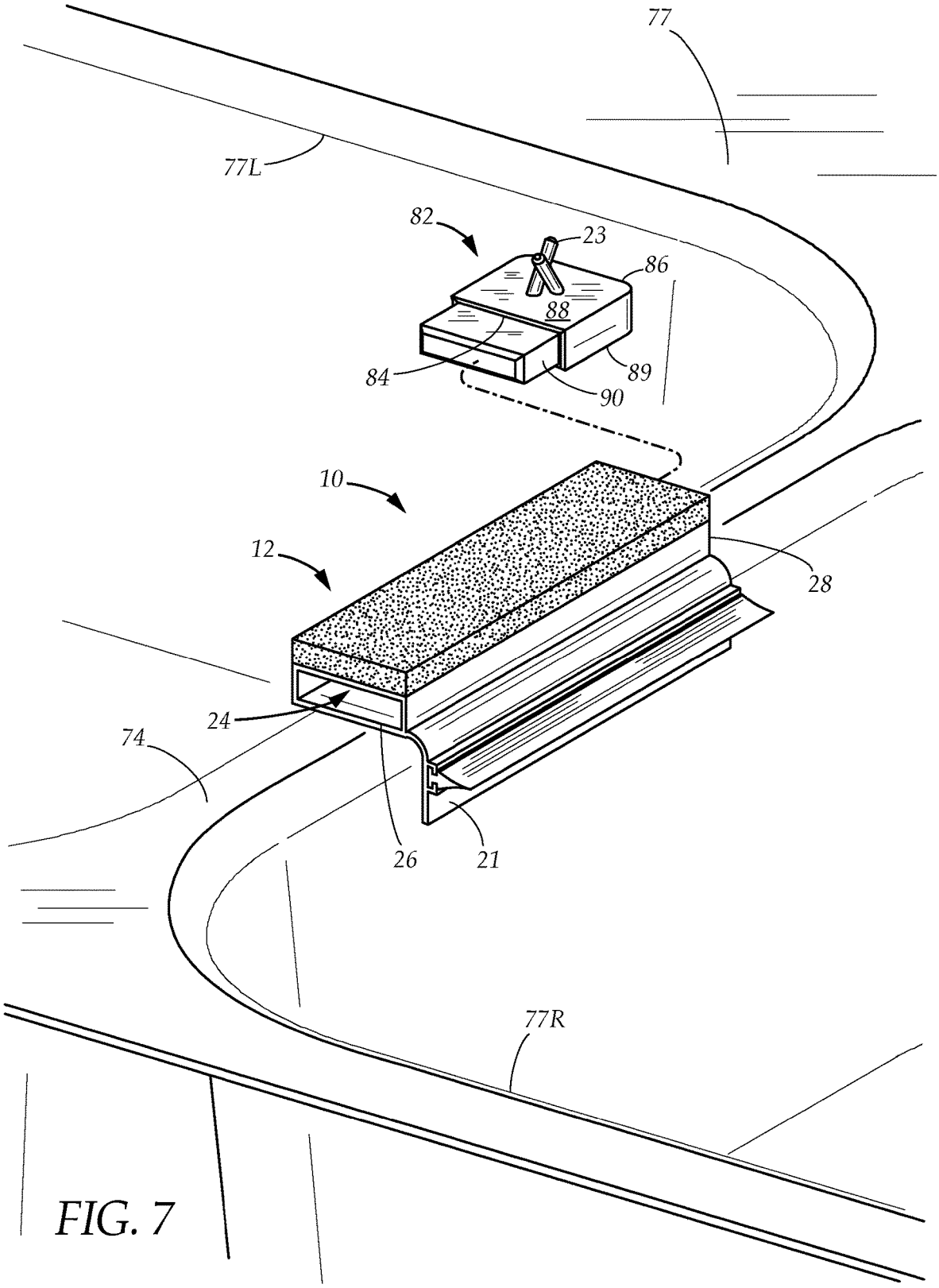
FIG. 7 is a perspective and partial exploded view of the sink accessory attached to the divider wall of a double basin sink, illustrating one manner in which the knife sharpener may selectively attach, to the first open end of the sink accessory according to one embodiment of the present disclosure.
Figure 8:
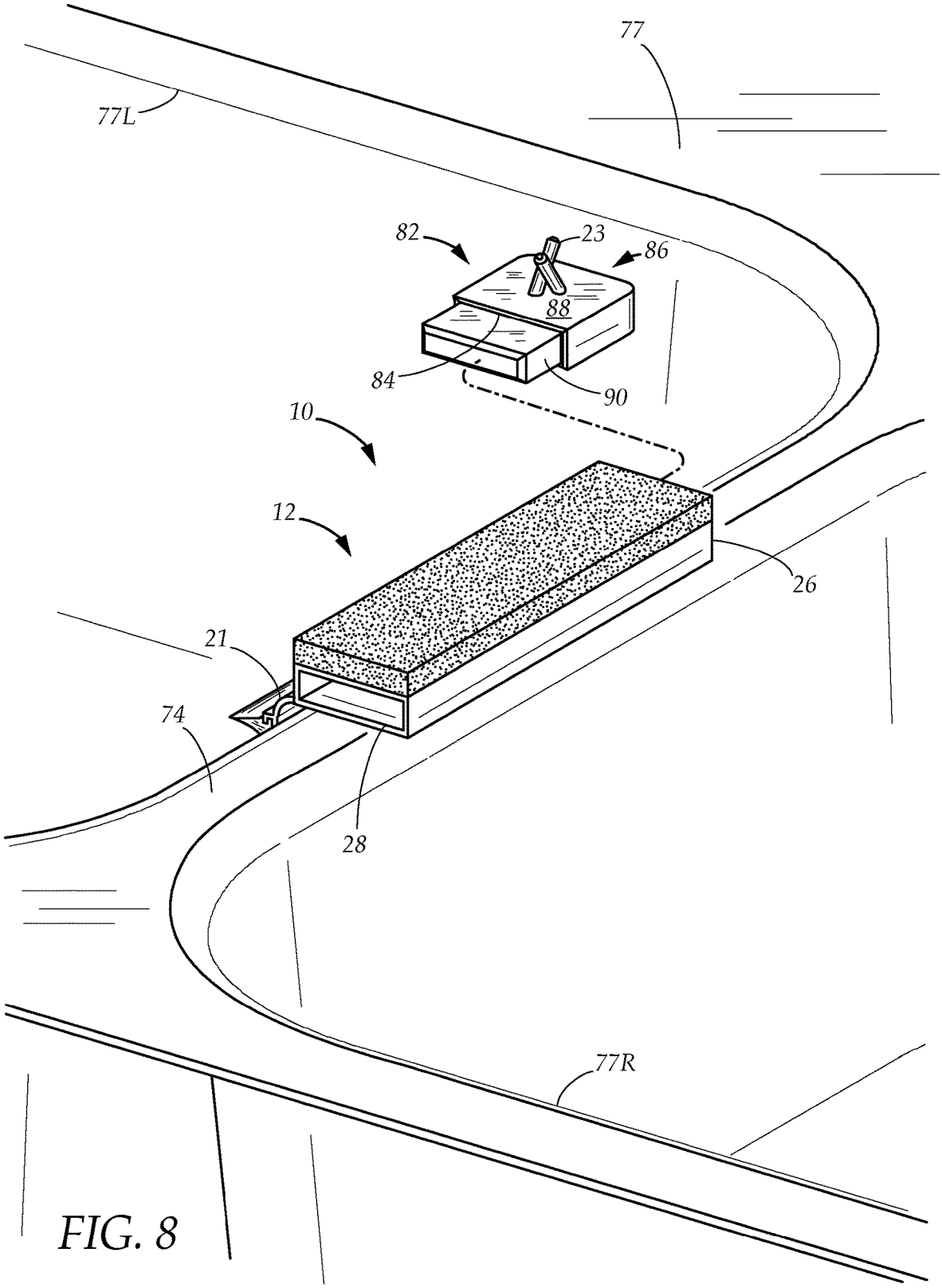
FIG. 8 is a perspective and partial exploded view of the sink accessory attached to the divider wall of a double basin sink, illustrating an alternative manner in which the knife sharpener attaches, to the second open end of the sink accessory according to one embodiment of the present disclosure.

Referring now to FIGS. 7 and 8, the double basin sink 77 has a left basin 77L and a right basin 77R. In embodiments, the sink accessory 10 comprises an auxiliary body 82 including a first end 84, a second end 86, an upper surface 88, and a lower surface 89. The auxiliary body 82 also includes an attachment member 90 and the knife sharpener 23. The attachment member 90 extends outwardly from the first end 84 of the auxiliary body 82. The attachment member 90 is sized and shaped to fit snugly within the interior volume 24 and is thereby configured to mate with the first open end 26 and the second open end 28 of the first elongated tubular body 12 to secure the auxiliary body 82 to the first elongated tubular body 12. In one embodiment, the attachment member 90 comprises substantially the same cross-sectional shape and size as the first open end 26 and the second open end 28 of the first elongated tubular body 12 such that the attachment member 90 creates a friction fit when inserted in the first open end 26 or the second open end 28.

Figure 6:
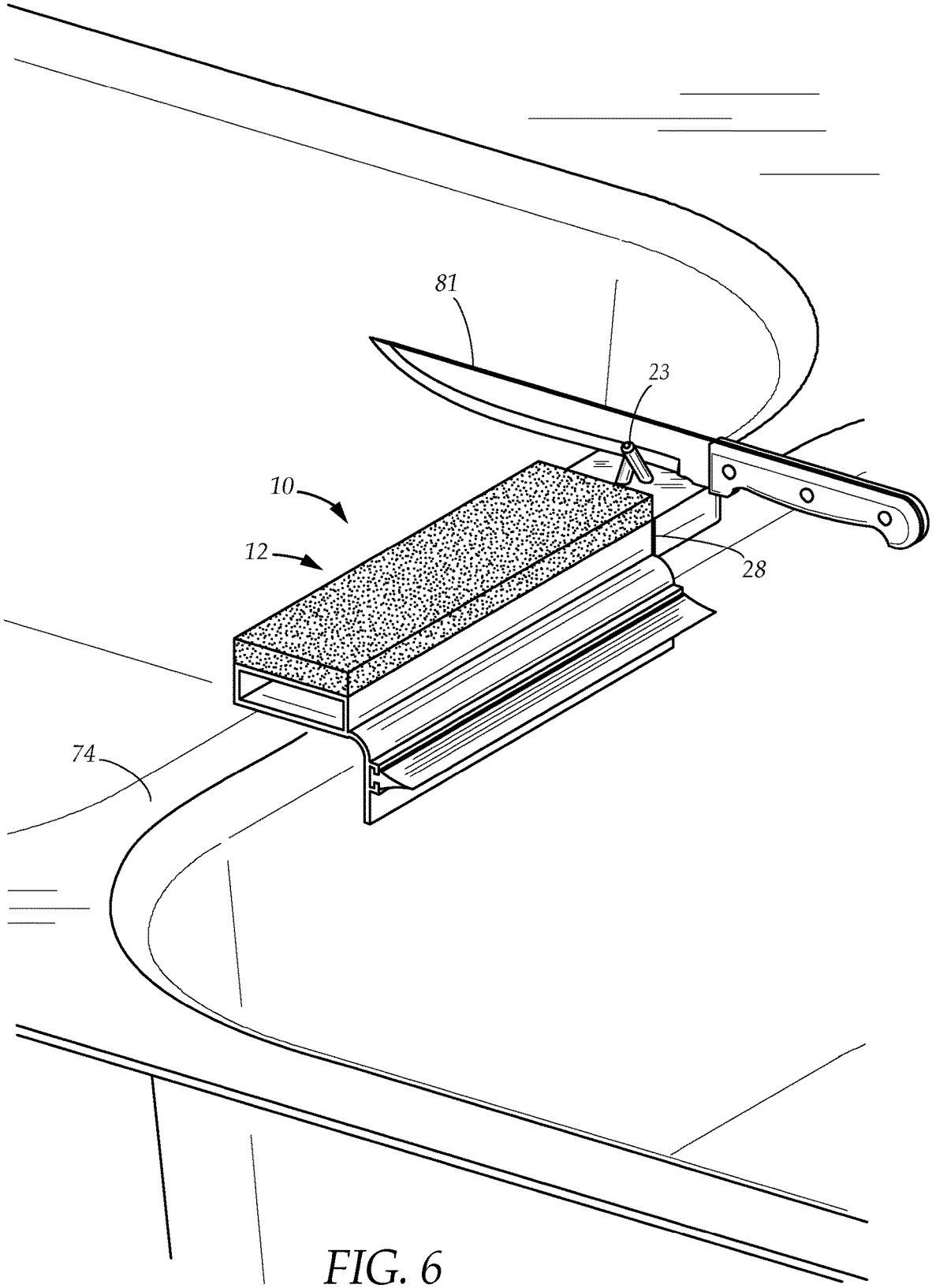
FIG. 6 is a perspective view of the sink accessory attached to the divider wall of a double basin sink, illustrating the knife sharpener in use according to one embodiment of the present disclosure.
Figure 9:
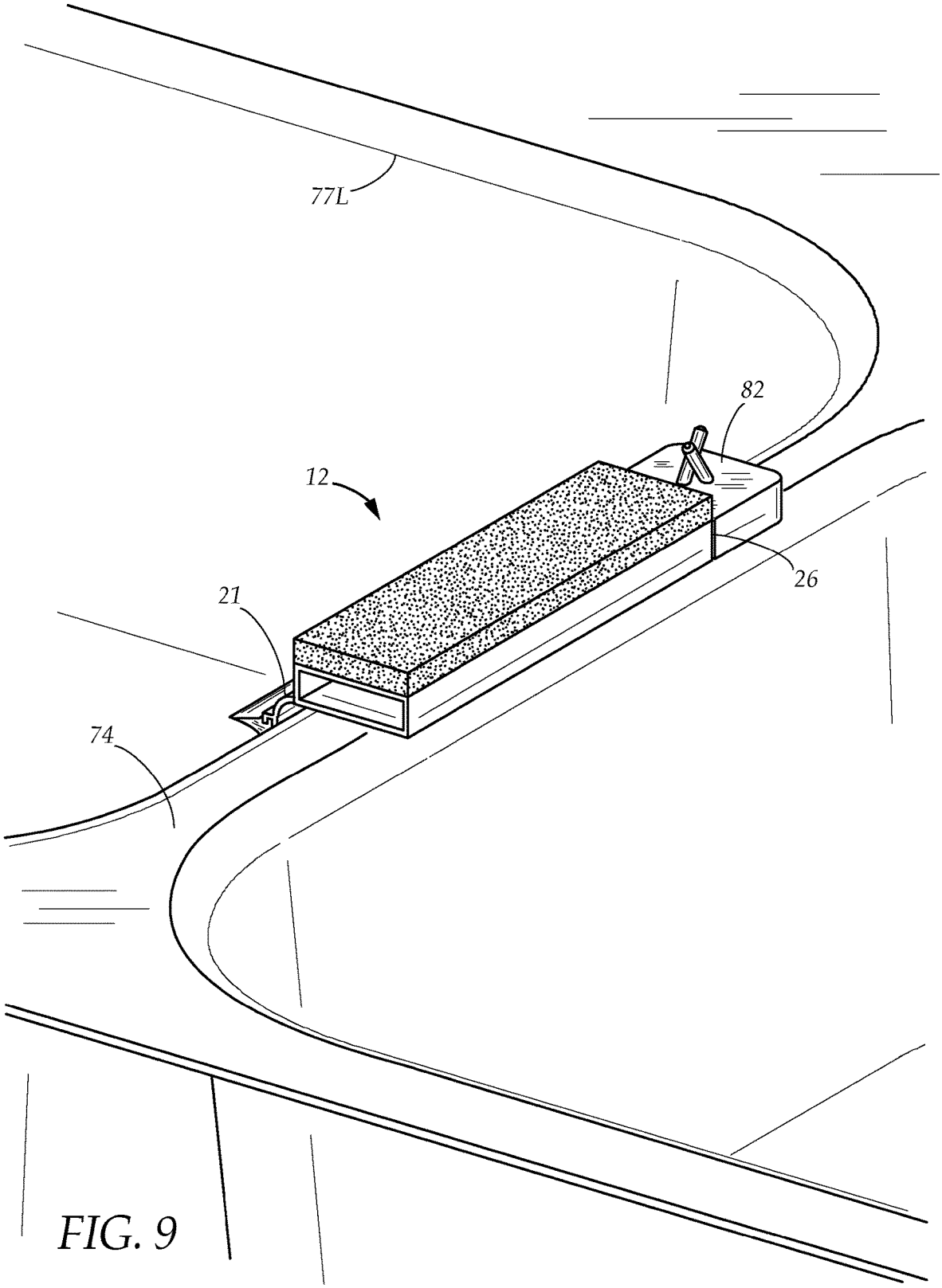
FIG. 9 is a perspective view of the sink accessory attached to the divider wall of a double basin sink, illustrating that the sink accessory can be mounted in alternative positions relative to the divider wall according to one embodiment of the present disclosure.

In embodiments, the knife sharpener 23 is disposed on the upper surface 88 of the auxiliary body 82. The knife sharpener 23 may be any type of knife sharpening apparatus known in the art. In some embodiments, the knife sharpener 23 protrudes upwardly relative to the upper surface of the first elongated tubular body 12 when attached to the first open end 26 or the second open end 28 of the first elongated tubular body 12. In one embodiment, the knife sharpener 23 is removably attached to the upper surface 88 of the auxiliary body 82. In another embodiment, the knife sharpener 23 is integral to the upper surface 88 of the auxiliary body 82. In operation, the knife sharpener 23 attaches to the second open end 28 when the sink accessory 10 is attached to the sink divider wall 74 and the arm 21 is positioned in the right basin 77R of sink (as shown in FIG. 7). Alternatively, the knife sharpener 23 attaches to the first open end 26 when the sink accessory 10 is attached to the sink divider wall 74 and the arm 21 is positioned in the left basin 77L of the sink (as shown in FIG. 8). In this way, the knife sharpener 23 can be positioned towards rearwardly on the sink accessory 10 regardless of the relative positioning of the sink accessory 10 on the sink divider wall 74. FIG. 9 shows the auxiliary body 82 attached to the first open end 26 of the first elongated tubular body 12 after the first elongated tubular body 12 has been attached to the sink divider wall 74 such that the arm 21 is positioned in the left basin 77L of the sink to accommodate left-handed users. FIG. 6 shows the knife sharpener 23 being employed to sharpen a knife 81 after being attached to the second open end 28 of first elongated tubular body 12 and while the sink accessory 10 is attached to the sink divider wall 74.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a sink accessory for use with a double basin sink. The disclosure is illustrated by example in the drawing figures, and throughout the written description. It should be understood that numerous variations are possible, while adhering to the inventive concept. Such variations are contemplated as being a part of the present disclosure.

What is claimed is:

1. A sink accessory for use with a sink including a sink divider wall having a top surface and a bottom surface, comprising:

a first elongated tubular body defining an interior volume and including a first open end, a second open end, an upper surface, a lower surface, and a longitudinal length;

a scouring pad attached to the upper surface of the first elongated tubular body;

an arm extending outwardly from the lower surface of the first elongated tubular body;

a squeegee attached to the arm;

a first magnet attached to the first elongated tubular body;

a second elongated tubular body defining an interior volume and including a first end, a second end, an upper surface, and a lower surface; and a second magnet attached to the second elongated tubular body;

wherein the second magnet and the first magnet are configured to attract each other to fasten the first elongated tubular body and the second elongated tubular body to the sink when the first elongated tubular body is positioned against the top surface of the sink divider wall and the second elongated body is positioned against the bottom surface of the sink divider wall.

2. The sink accessory of claim 1, further comprising:

an auxiliary body including a first end, a second end, an upper surface, and a lower surface;

an attachment member extending outwardly from the first end of the auxiliary body; and a knife sharpener attached to the upper surface of the auxiliary body;

wherein:

the attachment member selectively mates with one of the first open end and the second open end of the first elongated tubular body; and the knife sharpener protrudes upwardly relative to the upper surface of the first elongated tubular body when attached to the first open end or the second open end of the first elongated tubular body.

3. The sink accessory of claim 1, the scouring pad is coterminous with the upper surface.

4. The sink accessory of claim 1, wherein the scouring pad comprises:

a material selected from the group consisting of a mesh material; or a sponge-like material selected from the group consisting of polyester, polyurethane, and vegetal cellulose.

5. The sink accessory of claim 1, wherein:

the arm includes an arcuate region, a planar region, a fastener, and a longitudinal length;

the arcuate region curves away from the lower surface of the first elongated tubular body and into the planar region;

the planar region includes an outer surface facing away from the first elongated tubular body, and defines a first lateral edge, a second lateral edge, and a third longitudinal edge; and the fastener is disposed on the planar region of the arm.

6. The sink accessory of claim 5, wherein the fastener comprises a slot configured to removably receive the squeegee.

7. The sink accessory of claim 6, wherein the squeegee comprises a second fastener configured to removably engage the slot.

8. The sink accessory of claim 7, wherein:

the second fastener comprises a flange; and the flange mates with the slot to secure the squeegee within the slot.

9. The sink accessory of claim 8, wherein:

the flange includes the same cross-sectional area as the slot; and the flange and the slot are coterminous with each other when mating.

10. The sink accessory of claim 9, wherein the squeegee comprises a blade extending perpendicularly outwardly relative to the surface of the planar region when the squeegee is attached to the arm.

11. The sink accessory of claim 10, wherein the blade comprises a material selected from the group consisting of a flexible rubber and a silicone material and includes a smooth surface.

12. The sink accessory of claim 5, wherein the arm extends from the lower surface and curves downwardly so that it is adapted to engage a vertical wall of the sink divider wall while the planar region is generally parallel with the vertical wall when the first elongated tubular body is mounted onto the top surface of the sink divider wall.

13. The sink accessory of claim 12, wherein the arm extends from the first open end to the second open end and is coterminous with the longitudinal length of the first elongated tubular body.

14. The sink accessory of claim 13, wherein:

the first lateral edge and the second lateral edge of the planar region extend perpendicularly relative to the upper surface and the lower surface of the first elongated tubular body; and the third longitudinal edge of the planer region extends parallel relative to the upper surface and the lower surface of the first elongated tubular body.

15. The sink accessory of claim 14, wherein the fastener extends from the first lateral edge to the second lateral edge of the planar region of the arm and is coterminous with the longitudinal length of the arm.

16. The sink accessory of claim 12, further comprising an adhesive disposed on the upper surface of the second elongated tubular body, wherein:

the first magnet is attached within the interior volume of the first elongated tubular body;

the second magnet is attached within the interior volume of the second elongated tubular body; and the adhesive is adapted to attach the second elongated tubular body to the bottom surface of the sink divider wall to hold the second magnet in position towards the top surface of the sink divider wall to attract the first elongated tubular body when the first elongated tubular body is positioned against the top surface of the sink divider wall, thereby removably fastening the first elongated tubular body to the top surface of the sink divider wall when the first elongated tubular body is positioned against the top surface of the sink divider wall.

17. The sink accessory of claim 16, further comprising a magnetic diffuser separating the first magnet from the scouring pad and the arm to reduce a magnetic field around the scouring pad and the arm that is formed by the first magnet.

18. The sink accessory of claim 17, wherein the first magnet abuts the lower surface of the first elongated tubular body to form a magnetic field from the lower surface of the first elongated tubular body.

19. A sink accessory for use with a sink having a sink divider wall having a top surface, comprising:

a first elongated tubular body defining an interior volume and including a first open end, a second open end, an upper surface, a lower surface, and a longitudinal length;

a scouring pad attached to the upper surface of the first elongated tubular body;

an arm extending outwardly from the lower surface of the first elongated tubular body;

a squeegee attached to the arm;

a mounting member attached to the first elongated tubular body;

an auxiliary body including a first end, a second end, an upper surface, and a lower surface;

an attachment member extending outwardly from the first end of the auxiliary body; and a knife sharpener attached to the upper surface of the auxiliary body;

wherein:

the attachment member selectively mates with one of the first open end and the second open end of the first elongated tubular body; and the mounting member is configured to fasten the first elongated tubular body to the top surface of the sink divider wall when the first elongated tubular body is positioned against the top surface of the sink divider wall.

20. The sink accessory of claim 19, wherein the knife sharpener protrudes upwardly relative to the upper surface of the first elongated tubular body when attached to the first open end or the second open end of the first elongated tubular body.

* * * * *